United States Patent [19]

Rosa

[11] Patent Number: 4,643,237

[45] Date of Patent: Feb. 17, 1987

[54] METHOD FOR FABRICATING MOLDING OR SLOTTING BOARDS SUCH AS SHUTTER SLATS, MOLDING FOR CARPENTRY OR FOR CONSTRUCTION AND APPARATUS FOR PRACTICING THIS PROCESS

[76] Inventor: Jean Rosa, Bousquet, 47140 Pennes d'Agenais, France

[21] Appl. No.: 712,003

[22] Filed: Mar. 14, 1985

[30] Foreign Application Priority Data

Mar. 14, 1984 [FR] France ..... 84 04478

[51] Int. Cl.[4] ..... B27M 1/08; B27L 7/00

[52] U.S. Cl. ..... 144/369; 144/3 R; 144/39; 144/245 R; 144/368; 144/375

[58] Field of Search ..... 144/2 R, 2 C, 3 R, 20, 144/35 R, 39, 86, 92, 93 R, 199, 200, 201, 202, 203, 345, 346, 347, 358, 353, 354, 359, 367, 368, 375, 36, 37, 41, 245 R, 246 R, 369

[56] References Cited

U.S. PATENT DOCUMENTS

| | | | |
|---|---|---|---|
| 194,304 | 8/1877 | Levin | 144/203 |
| 2,780,253 | 2/1957 | Joa | 144/246 C |
| 2,789,598 | 4/1957 | Berger | 144/35 |
| 3,099,301 | 7/1963 | Bennett . | |
| 3,187,612 | 6/1965 | Hervey | 83/5 |
| 4,033,391 | 7/1977 | Troutner | 144/35 R |
| 4,422,488 | 12/1983 | Lacroix | 144/368 |
| 4,471,822 | 9/1984 | Griganavicius | 144/3 R |

FOREIGN PATENT DOCUMENTS

| | | |
|---|---|---|
| 0053835 | 3/1984 | European Pat. Off. . |
| 30554 | 7/1884 | Fed. Rep. of Germany . |
| 49372 | 4/1889 | Fed. Rep. of Germany . |
| 179025 | 6/1905 | Fed. Rep. of Germany . |
| 527959 | 11/1921 | France . |
| 2424400 | 11/1979 | France . |

*Primary Examiner*—W. D. Bray

*Attorney, Agent, or Firm*—Young & Thompson

[57] ABSTRACT

A piece of board stock is advanced on a conveying table between a pair of milling units mounted about and below the table. Each milling unit comprises at least one milling tool having a pair of spaced rotary cutting blades and a profiling tool of lesser diameter than these blades sandwiched therebetween. For each pair of blades on the upper milling unit, there is a corresponding pair of blades on the lower milling unit disposed in coplanar relation therewith. Each pair of blades is so dimensioned as to cut at least halfway, but not all the way, through the piece of advanced board stock, and each profiling tool is so dimensioned as to profile the adjacent surface of the board stock. In this manner, a piece of advanced board stock is simultaneously cut into a plurality of slats having opposed profiled edges, and this is done in a single pass.

10 Claims, 7 Drawing Figures

METHOD FOR FABRICATING MOLDING OR SLOTTING BOARDS SUCH AS SHUTTER SLATS, MOLDING FOR CARPENTRY OR FOR CONSTRUCTION AND APPARATUS FOR PRACTICING THIS PROCESS

The present invention relates to a process for the fabrication of moldings or slotting boards such as shutter slats, molding for carpentry or for construction and apparatus for practicing this process.

The fabrication of grooved boards or molding is effected in known manner starting from a beam which is cut up board by board or simultaneously, each board being then one after the other finished on a grooving or molding machine. In the case of the fabrication of the slats of swinging shutters, these comprise on their small longitudinal sides a groove and a tongue obtained by the preceding machining.

The assembly of the boards is of the tongue and groove type. It is known, so as to assemble the swinging shutters formed by this assembly, to nail the boards together. To this end, after the machining of the boards, these are assembled and drilled and/or notched perpendicular to the small finished side. The consolidating nails therefore pass through the apertures or notches provided in the boards and thus ensure their securement.

It happens that this process has numerous drawbacks burdening the production and hence the cost of the grooved boards or moldings. Thus, the machinings take place independently of each other, which entails removing the machined pieces requiring readjustment of the machines performing the subsequent operations. This removal and adjustment leads to loss of time and substantial decrease in the output of the operation.

The present invention aims to overcome all these drawbacks by providing a process for fabrication eliminating the removal of the product for the following operation and therefore its replacement and multiplying the output by substantial amounts relative to known processes and by providing an apparatus for carrying out this process.

To this end, the process according to the invention is characterized essentially in that it consists, starting with a dressed beam, in providing on at least one major face of said beam and in at least a same plane perpendicular to at least one of said large sides at least one machined contour and at least one finished side simultaneous to the working or workings on at least half the height of the beam and between two workings and/or between a finished edge and an edge of said beam.

Other advantages and characteristics will appear from a reading of the description with reference to the accompanying drawings given by way of non-limiting example and in which.

The process of fabricating tongue and groove boards, of moldings for carpentry or for construction or the like according to the invention consists, starting from a dressed beam, in providing on at least one major face of said beam and in at least one same plane perpendicular to at least one of said major faces, at least one side finishing simultaneous to the operations over at least half the height of a beam and between two side finishings and/or between a side finishing and one edge of said beam.

Preferably, in the process according to the invention before the simultaneous delineation and shaping in at least a same plane and after the dressing of the beam is effected a length adjustment of said beam.

The tongue or groove boards or moldings obtained by the process according to the invention may be used in different applications. In the case in which these boards are adapted for the construction for example of a swinging shutter, the assembly of these is effected by means of steel nails. As a result, these boards leaving the plant should have transverse openings for the passage of nails.

To this end, the process according to the invention for fabrication of tongued or grooved boards, of moldings for contruction or for carpentry and more particularly of boards whose assembly is effected by means of nails to form a swinging shutter or the like, consists, after the length adjustment of the dressed beam and before the shaping operation or operations and the simultaneous delineation in a same plane, in providing openings disposed along lines and columns, provided on a major face of said beam and traversing it from side to side.

The process for fabrication of tongue and groove boards and more particularly for boards whose assembly is effected by means of nails to form a swinging shutter or the like, consists in combination in effectuating a length adjustment of the dressed beam, piercing through said beam perpendicularly to its major faces at several points disposed on lines and columns and in providing at least one side finishing over at least half the height of the beam between two lines of holes and/or between a line of holes and an edge of said beam and at least a forming operation simultaneously with the side finishing and in a same plane on at least one major face of the beam between two planes of side finishing and/or between a side finishing plane and an edge of said beam.

Figure 5:
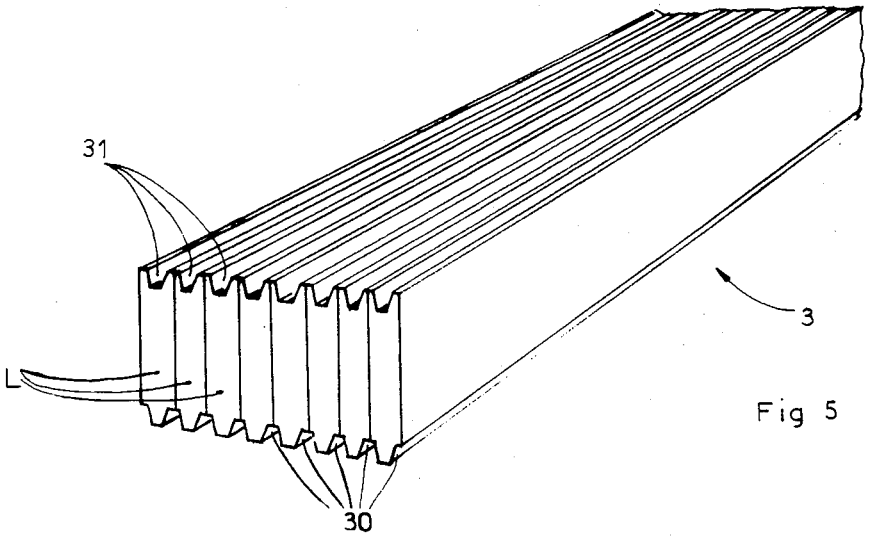
FIGS. 5 and 6 are views of tongue and groove boards obtained by the process according to the invention.
Figure 6:
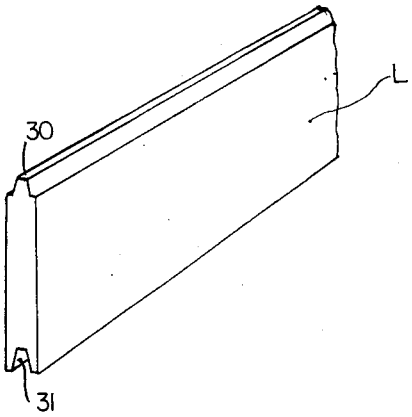

The grooved or contoured boards adapted for example for the construction of swinging shutters, floors or the like comprise on their edges an assembly shape, for example a tongue 30 and a groove 31 respectively on each edge (FIG. 5). As a result, in the process according to the invention at least one shaping operation is performed on the two opposite major faces of the beam and at least one side finishing simultaneously with the operations is effected on at least the two half heights of said beam and between two operations and/or between an operation and an edge of said beam. Preferably before or after the piercing operations the process according to the invention can comprise mortising operations and/or cutting or the like. The process according to the invention permits obtaining simultaneously all the boards grooved or contoured by a shaping operation and simultaneously side finished.

Figure 1:
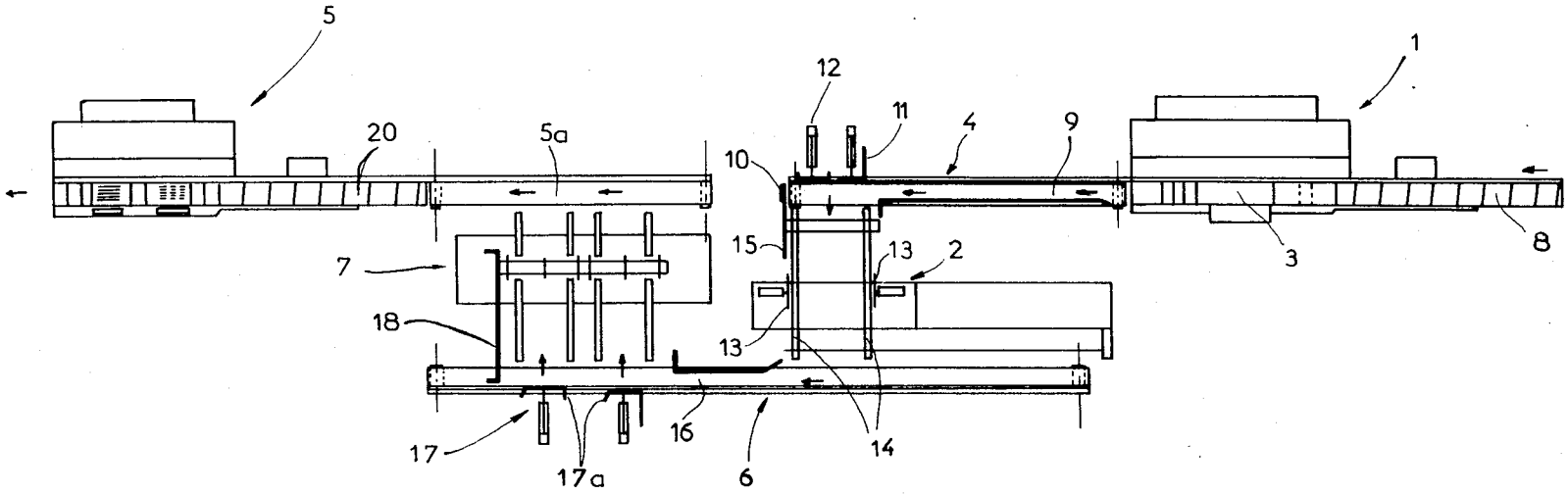
FIG. 1 is an assembly view of the apparatus for practicing the process according to the invention.

The apparatus for practicing the process according to the invention shown in FIG. 1 comprises a dressing station 1, a station 2 for length adjustment of the beams 3 previously dressed, transfer means 4 from the dressing station 1 to the length adjustment station 2, a simultaneous side finishing and machining assembly 5 and feed means 6 for the beams 3 between the length adjustment station 2 and the simultaneous side finishing and machining assembly 5.

In the case in which the apparatus for practicing the process according to the invention is intended for the production of grooved or contoured boards whose assembly is effectuated by means of steel nails so as, for example, to form swinging shutters or the like, said apparatus comprises between the lengthwise positioning station 2 of a beam 3 and the simultaneous side finishing and machining assembly 5, a drilling station 7.

Before or after this drilling station the device can comprise mortising and/or cutting stations or according to another embodiment depending on the use of the boards or the moldings the apparatus is provided between the length adjustment station and the assembly 5 with a mortising and/or cutting station.

The dressing station 1 of the device according to the invention of known type permits machining the sides and the major faces of the beam 3 by milling and/or planing to form them to size. The beams 3 are disposed on table 8, preferably movable, in the dressing station and are continuously machined in said station.

At the exit from the dressing station 1, the beams are fed toward the length adjustment station 2 by transfer means 4. These transfer means are preferably constituted by an endless belt 9 feeding the beam 3 against an abutment 10 and by a blade 11 actuated in translation perpendicular to belt 9 by means of a jack 12. The beam 3 rests during its transfer on two bars 14 and is guided by lateral plates 15 to the length adjustment station 2.

This length adjustment station 2 comprises according to a preferred embodiment two circular saws 13 or the like spaced apart an adjustable distance equal to the desired length of the beam.

Said beam is pushed between these two saws by the blade 11 then to the feed means 6 of the beams toward the simultaneous machining and side finishing assembly 5. The feed means 6 are preferably also constituted by an endless belt 16; but it is to be noted that any other type of means may be suitable.

In the case in which the apparatus is adapted to produce boards destined to be assembled by means of steel nails, the feed means 6 comprise at least one retaining means 17 for the beams approaching the drilling station 7. This holding means 17 is constituted according to a preferred embodiment by a pusher 17A acting perpendicular to the endless belt 16.

At the end of the endless belt 16 is mounted an abutment 18. When the beam comes into contact with this abutment, the pusher 17A feeds said beam toward the drilling station 7. Preferably, the device according to the invention is provided with two pushers 17A acting parallel and permitting the charging of the two beams 3 to the drilling station. It follows that the device according to the invention comprises two guides between the endless belt 16 and the drilling station 7.

The beams are emplaced and maintained in place below said drilling station 7 by pushers 17A. The drilling station 7 is constituted preferably by at least one vertical multi-tool drill permitting the drilling of all the holes simultaneously.

The holes are aligned along lines and columns. The number of columns is a function of the length of the beams and their destination as to their utilization. The number of lines is equal to the number of side finished tongued or molded boards leaving the device according to the invention. Preferably, the drills of the drilling device may be spaced from each other in an adjustable fashion and as a function of the parameters set forth above.

The bores are formed on a major horizontal face of the beam 3 and pass through the latter from side to side. According to another embodiment, the drilling station may comprise at least one horizontal drill so as to effect drilled holes on the vertical sides of the beam. Preferably the device may be provided with at least one drilling station and/or mortising station and/or cutting station. After formation of these bores and/or cuts and/or mortises according to the above arrangement, the beams are fed toward the simultaneous machining and delineation assembly 5 by the pusher 17A.

Figure 2:
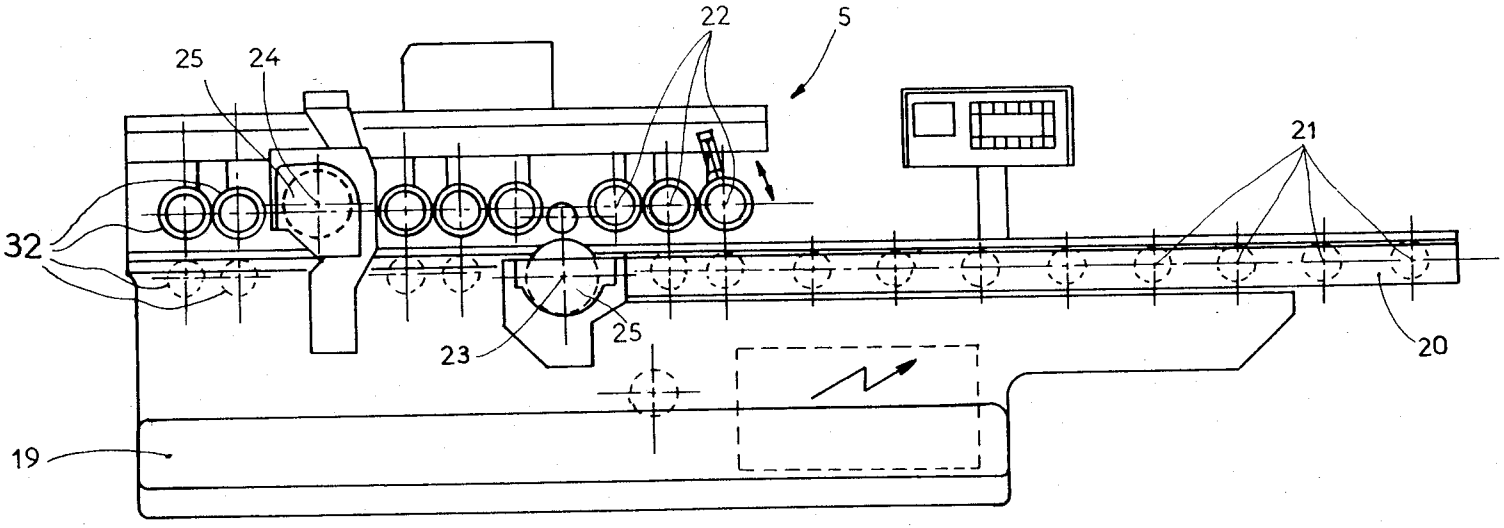
FIG. 2 is a view of a portion of FIG. 1.

Preferably, the beams 3 are disposed on an endless belt 5A which carries them towards said assembly 5. The assembly 5 for simultaneous side finishing and shaping, of the device according to the invention, shown in FIG. 2, comprises a construction 19, a movable table 20 and a roller 21 driven in rotation, a series of upper rollers 22 aligned in a plane parallel to the movable table 20 of which at least one is driven and adjustable as to height, a lower rotatable shaft 23 and an upper rotatable shaft 24.

The upper shaft 24 and lower shaft 23 are parallel and are preferably offset relative to each other. According to a preferred embodiment, the lower shaft 23 is rearwardly offset relative to upper shaft 24 with respect to the direction of advance of the boards in the assembly 5. On each of the upper and lower shafts 24 and 23 are mounted side-finishing tools 25 and milling tools 26.

Figure 3:
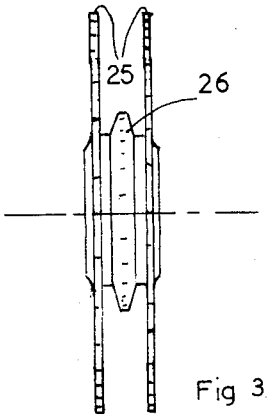
FIGS. 3 and 4 are views of tools of the apparatus according to the invention.
Figure 4:
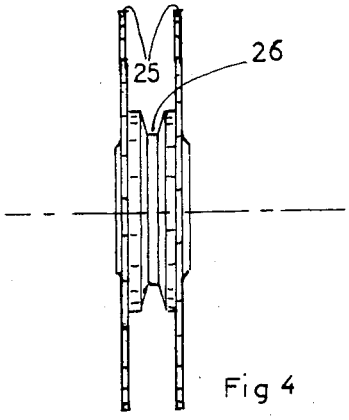

As shown in FIGS. 3 and 4, the milling tools 26 of each shaft 23 and 24 constitute inserts between the side-finishing tools 25. The side-finishing tools 25 are constituted by circular saws and are disposed on the shafts 23 and 24 in several parallel planes perpendicular to said shafts.

The milling tools 26 are constituted for example by cutters having a profile corresponding to a tongue or groove or the like it is desired to produce on the slats.

The side finishing tools 25 and the milling tools 26 of the lower shaft 23 are aligned in several parallel planes perpendicular to said shaft, to the side finishing tools 25 and to the milling tools 26 of the upper shaft 24.

The milling tools shown in FIGS. 3 and 4 are adapted to produce a groove 31 (FIG. 3) and a tongue 30 (FIG. 4) but it will be understood that any other tool may be used to produce other profiles.

Figure 7:
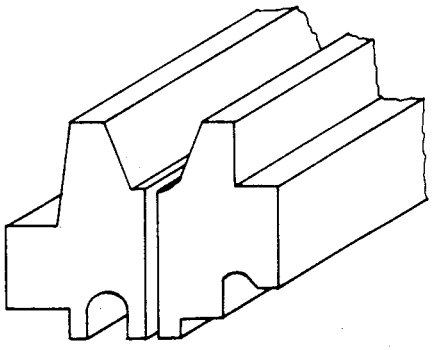
FIG. 7 is a view of another form of product obtained by the process according to the invention.

For example the milling tools may have a profile adapted to produce carpentry moldings as shown in FIG. 7.

In the simultaneous side finishing and milling assembly 5, the board 3 is driven by rollers 21 on the table 20 then by at least one upper roller 22 between the side finishing and milling tools 25 and 26.

Preferably, the assembly 5 comprises means for positioning the boards 3 relative to the tools and as a function of the position of the cutting lines.

Thus the boards are positioned in the assembly 5 such that a line of cuts passes between two side finishing tools 25.

The boards 3 are first milled on their lower face by milling tools 26 of the lower shaft 23 and are cut through for half their lower height by circular saws 25 on the lower shaft simultaneously with the milling and in the same plane perpendicular to the lower face.

When the boards arrive at the level of the upper shaft 24, the upper face is milled and the cutting through is simultaneously effected and in the same plane perpendicular to the upper face by circular saws operating on the upper half of the height of said board.

Preferably the apparatus according to the invention comprises, immediately after the last shaft carrying milling and side finishing tools, at least one pair of series of parallel lower and upper contoured rollers 32 driven in rotation so as to ensure the movement and support of each of the slats L in the direction of their height.

These series of contoured rollers 32 are each secured on an upper shaft and a lower shaft driven in rotation and parallel to each other.

The rollers of each series are aligned with the machining tools and have the same profile as the profile obtained by the machining tool with which they are aligned. Preferably the apparatus according to the invention is provided with two pairs of series of upper and lower contoured rollers 32. These contoured rollers 32 permit, by supporting each one, preventing the slats L to become displaced from each other and preventing the fanning out of said slats so as to avoid danger of jamming the side finishing tools.

As shown in FIG. 5, when the board leaves the apparatus according to the invention, all the slats L are delivered and finished simultaneously.

The assembly for side finishing and milling preferably comprises suction means preferably for each tool, drive means for the upper and lower shafts as well as drive means for the rollers, for the members for adjusting their vertical position with respect to the movable table 20.

Preferably, the lower and upper shafts 23 and 24 may be disposed relative to each other and in the horizontal plane in an adjustable manner such that the assembly 5 can receive any height of board.

According to a preferred embodiment, the shafts 23 and 24 are guided in double bearing blocks (not shown).

The apparatus for carrying out the process according to the invention is preferably automatic, so as to be able to work continuously.

It follows that said apparatus comprises on the various stops transfer means and at these different work stations contacts emitting signals for the motors of the devices.

The process and apparatus for practicing it according to the invention permit producing in a rapid and continuous manner tongue and groove slats without the necessity to effect adjustment of the different work stations after each operation.

It follows that the present invention may be subject to any modifications or variations within the range of technical equivalents, without thereby departing from the scope of the present patent.

I claim:

1. Apparatus for making slats having opposed profiled edges from board stock, said apparatus comprising a planar table having means for advancing the board stock in a given direction, a first milling unit mounted for rotation about an axis parallel to and beneath the plane of said table and perpendicular to said given direction, a second milling unit mounted for rotation about an axis parallel to and above the plane of said table and perpendicular to said given direction, and drive means for driving said first and second milling units in rotation, said first and second milling units each comprising at least one milling tool, each said at least one milling tool comprising a pair of spaced parallel rotary cutting blades and a profiling tool mounted between said pair of rotary cutting blades and having a lesser diameter than said pair of blades, each said at least one milling tool being so dimensioned that its pair of cutting blades will cut at least half way but not all the way through a piece of advanced board stock and its profiling tool will profile the adjacent surface of said piece of advanced board stock, each said at least one milling tool of said first milling unit having its pair of cutting blades disposed coplanar with a pair of cutting blades of said second milling unit, whereby a plurality of slats having opposed profiled edges may be formed in a single pass from a said piece of advanced board stock.

2. Apparatus according to claim 1, and upper and lower guide rollers disposed downstream of said first and second milling units, said upper and lower guide rollers being mounted for rotation respectively about first and second axes parallel to the axes of rotation of said first and second milling units, and upper and lower guide rollers being so dimensioned and positioned as to bear respectively on the upper and lower profiled edges of said plurality of slats.

3. Apparatus according to claim 1, and means disposed upstream of said first and second milling units, for cutting said board stock to a predetermined length and advancing said board stock to said planar table.

4. Apparatus according to claim 1, wherein said first and second milling units are offset from one another in said given direction.

5. Apparatus according to claim 3, wherein said first and second milling units are offset from each other in said given direction, such that said axes of rotation of said first and second milling units are offset at a distance in said given direction not exceeding said predetermined length of said board stock.

6. Apparatus according to claim 1, wherein said means for advancing the board stock comprises rollers disposed upstream of said second milling unit, and means for driving said rollers in rotation so as to advance said board stock.

7. Apparatus according to claim 1, wherein each said profiling tool of said first milling unit is so dimensioned as to impart a tongued profile to said board stock, and each said profiling tool of said second milling unit is so dimensioned as to impart a grooved profile to said board stock.

8. Process for making slats having opposed profiled edges from board stock, said process comprising the steps of:

providing a piece of board stock of predetermined length;

advancing said piece of board stock in a given direction;

simultaneously cutting a plurality of parallel grooves on the bottom face of said piece of board stock and profiling the bottom face of each piece of board stock between each two adjacent grooves, said grooves extending in said given direction and penetrating said piece of board stock at least halfway, but not all the way, through its thickness;

simultaneously cutting a second plurality of grooves coplanar with said first plurality of grooves on the top face of said piece of board stock and profiling the top face of each piece of board stock between each two adjacent grooves, said grooves extending in said given direction and penetrating said piece of board stock at least halfway, but not all the way, through its thickness.

9. Process according to claim 8, and guiding said plurality of profiled slats downstream of said first and second milling units with upper and lower profiled guide rollers so dimensioned and positioned as to bear respectively against the upper and lower profiled edges of said plurality of slats.

10. Process according to claim 8, wherein said bottom and top milling operations are performed sequentially.

* * * * *